US010693260B2

(12) United States Patent
Beischer et al.

(10) Patent No.: US 10,693,260 B2
(45) Date of Patent: Jun. 23, 2020

(54) MOUNTING FRAME COMPRISING A PE CONTACT

(71) Applicant: HARTING Electric GmbH & Co. KG, Espelkamp (DE)

(72) Inventors: Thomas Beischer, Espelkamp (DE); Florian Schenk, Löhne (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/479,260

(22) PCT Filed: Mar. 6, 2018

(86) PCT No.: PCT/DE2018/100198
§ 371 (c)(1),
(2) Date: Jul. 19, 2019

(87) PCT Pub. No.: WO2018/171831
PCT Pub. Date: Sep. 27, 2018

(65) Prior Publication Data

US 2019/0386434 A1 Dec. 19, 2019

(30) Foreign Application Priority Data

Mar. 21, 2017 (DE) ..... 10 2017 106 036

(51) Int. Cl.
*H01R 13/648* (2006.01)
*H01R 13/518* (2006.01)

(52) U.S. Cl.
CPC ..... *H01R 13/648* (2013.01); *H01R 13/518* (2013.01)

(58) Field of Classification Search
CPC .. H01R 13/648; H01R 13/518; Y10S 439/939
See application file for complete search history.

(56) References Cited

U.S. PATENT DOCUMENTS

| | | | | |
|---|---|---|---|---|
| 4,506,937 | A * | 3/1985 | Cosmos | H01R 13/648 439/101 |
| 4,688,868 | A * | 8/1987 | Noyes | H01R 13/6596 439/108 |
| 4,874,336 | A | 10/1989 | Marsh | |
| 2010/0216338 | A1 | 8/2010 | Wang et al. | |
| 2014/0220810 | A1 | 8/2014 | Lappoehn | |
| 2017/0110824 | A1 | 4/2017 | Beischer | |
| 2018/0115103 | A1 | 4/2018 | Schlegel | |

FOREIGN PATENT DOCUMENTS

| | | |
|---|---|---|
| DE | 10009749 | 11/2004 |
| DE | 102011107768 A1 | 1/2013 |
| DE | 102013113976 A1 | 6/2015 |
| DE | 102014109351 | 7/2015 |
| DE | 102015106416 | 6/2016 |
| EP | 0333386 A1 | 9/1989 |
| WO | 2008152520 A2 | 12/2008 |

* cited by examiner

*Primary Examiner* — Briggitte R. Hammond
(74) *Attorney, Agent, or Firm* — Smartpat PLC

(57) ABSTRACT

The invention relates to a mounting frame (5) which comprises at least one PE contact (1) and can be inserted into the housing from a plug-in end and/or from a terminal end. The at least one PE contact (1) is arranged on the mounting frame (5). Previously known PE contacts can be contacted only from one end, whereas the disclosed PE contact (1) can be contacted from the terminal end and/or the plug-in end.

11 Claims, 2 Drawing Sheets

MOUNTING FRAME COMPRISING A PE CONTACT

TECHNICAL FIELD

The disclosure relates to a mounting frame comprising a PE contact. Contacts of this kind are needed in order to guarantee the earthing of a plug connector with contacts inserted.

BACKGROUND

DE 10 2014 109 351 B3 discloses a plug connector with a protective conductor bridge. The protective conductor bridge serves as a connection between two PE contacts in a plastic housing. It has to be mounted on the side of the plug insert.

DE 100 09 749 B4 discloses a contact fastening for rectangular plug connectors in which a means for bringing a PE contact into contact is also disclosed. In this case, the PE contact is engaged in its own chamber and aligned with a flange opening and a spring element.

DE 10 2013 113 976 B4 discloses a mounting frame with a connection region for a PE contact. The metallic design of the mounting frame means that earthing is guaranteed within a metallic housing.

The disadvantage of the prior art is that in the solutions known in the art, the PE contact cannot be used with a plastics mounting frame.

The German Patent and Trademark Office has conducted a search of the following prior art in the priority application relating to the present application: DE 10 2015 106 416 B3 and DE 10 2014 109 351 B3 which has already been mentioned above.

SUMMARY

The problem addressed by the invention is that of presenting a mounting frame with a PE contact which is easy and quick to mount and is also cheap to produce. The problem is solved by the mounting frame as claimed. Advantageous embodiments are specified in the dependent claims.

The disclosure relates to a mounting frame with at least one PE contact, wherein the mounting frame can be received in a housing. The housing has a plug-in end and a terminal end, wherein the mounting frame is suitable for receiving at least one plug insert. The mounting frame can be inserted into the housing from the plug-in end and/or from the terminal end, wherein the at least one PE contact is arranged on the mounting frame. The at least one PE contact can be brought into contact from the terminal end and/or from the plug-in end.

Mounting frames of this kind are used for mounting plug connector modules, wherein the mounting frame is fitted with different plug connector modules and then inserted into a plug connector housing and screwed thereto. The mounting frame in this case must be mechanically stable so that it is able to withstand the plug-in and pulling forces that occur during the assembly or breaking of the plug connection. Metallic and plastic mounting frames exist from the prior art, wherein in the case of metallic mounting frames, transmission of the one PE contact to the plug connector as a whole is ensured by the metallic material of the mounting frame. Mounting frames are most commonly used in conjunction with so-called heavyweight plug connectors.

Furthermore, there are different kinds of plug connector modules. There are plug connector modules for the transmission of power, data or signals. Since the modules do not fall within industrial property rights, the nature of the modules used will not be dealt with in further detail below either.

The insertability of the mounting frame into the housing from the terminal end and/or from the plug-in end advantageously makes fitting easier for production staff. This means that cables can be manufactured prior to the assembly process.

The arrangement on the mounting frame and embodiment of the PE contact means that it is possible for a contact to be made from the terminal end and/or from the plug-in end. This simplifies the entire assembly process.

In an advantageous embodiment, the at least one PE contact has a two-limb configuration. The two-limb configuration is understood to mean that the PE contact is made up of two bent elements. The bending of the elements roughly corresponds to a U-shape. In this case, the connection piece between the two limbs is longer than the two limbs formed thereon. Ideally, the connection piece has as its length the height of the mounting frame, so that it can enclose this in the region of the corners.

The two elements of the PE contact are arranged at right angles to one another and overlap in the two limbs of the "U". This increases the current-carrying capacity and the contact-making surface in relation the mounting frame and therefore to the housing.

A single-limb design is conceivable as a further embodiment. For this purpose, only one element is used rather than two elements. The one element in this case is curved in a roughly U-shape. The connection piece between the two limbs is longer in this case than the two limbs formed thereon. Ideally, the connection piece has as its length the height of the mounting frame, so that it can enclose this in the region of the corners.

In a further embodiment, the at least one PE contact has an integral design. The integral form corresponds, in terms of shape, to the two-limb design of the PE contact. Alternatively, in the integral design, it is also possible for there to be only one fixed connection between a limb of the two elements, while the limbs are separate at the other end, so that they can be arranged in overlapping fashion.

In a particularly preferred embodiment, the at least one PE contact can be fixed to the mounting frame in a form-fitting manner. The form-fitting design means that the stability between the mounting frame and the PE contact is substantially improved. The two-limb design of the PE contact is optimally suited to form-fitted fixing, because each of the two elements therefore abuts the corner edge of the mounting frame.

In a particular embodiment, the at least one PE contact can be mounted on all four corners of the mounting frame. The shape and two-limbed embodiment of the PE contact means that it can be flexibly mounted on each of the corners of the mounting frame. This in turn increases convenience when wiring the plug connector.

In an advantageous embodiment the at least one PE contact has at least one recess for fastening to the mounting frame. The embodiment with at least one recess guarantees secure fastening of the PE contact to the mounting frame and therefore to the housing. The recess acts as a through-hole for screws or mounting means of the mounting frame on the housing. In an alternative variant, the recess has a thread for additional fixing.

In a particularly advantageous embodiment, the at least one PE contact is made of a conductive material, for example metal, in particular a copper alloy or spring steel. The copper alloy is CuSn6, CuSn8 or Wieland K57 (CuNi1Co1Si), for example. The conductivity, short-circuit load-bearing capacity and current-carrying capacity is substantially increased by the metallic material. The particularly high current-carrying capacity and short-circuit load-bearing capacity was demonstrated experimentally in various tests.

In a particular embodiment, the mounting frame has at least one threaded sleeve. The at least one threaded sleeve is arranged in a corner of the mounting frame. Ideally, the mounting frame has at least four threaded sleeves for a secure and conductive screw connection to the housing of the plug connector.

In a preferred embodiment, the threaded sleeve is made of brass. This is used to further improve conductivity.

In an advantageous embodiment, the mounting frame is made of plastic. Where a mounting frame is made of plastic, the advantage of the PE contact is increased because a metallic mounting frame itself represents a conductive connection between the PE contact and the housing. This is not guaranteed in the case of a plastics mounting frame due to the insulating properties. However, since a plastics frame can be produced more easily and cost-effectively, it is preferable and can be used in combination with the PE contact.

In a particularly preferred embodiment, the housing is made of metal, in particular aluminum. The metallic design means that the housing is stable and can at the same time be used for earthing when the mounting frame with at least one PE contact is inserted therein.

An exemplary embodiment of the invention is depicted in the drawings and is explained in greater detail below.

DETAILED DESCRIPTION

The figures contain partially simplified, schematic representations. Identical reference numbers are used in part for the same, but possibly not identical, elements. Different views of the same elements could have different scales.

Figure 1:
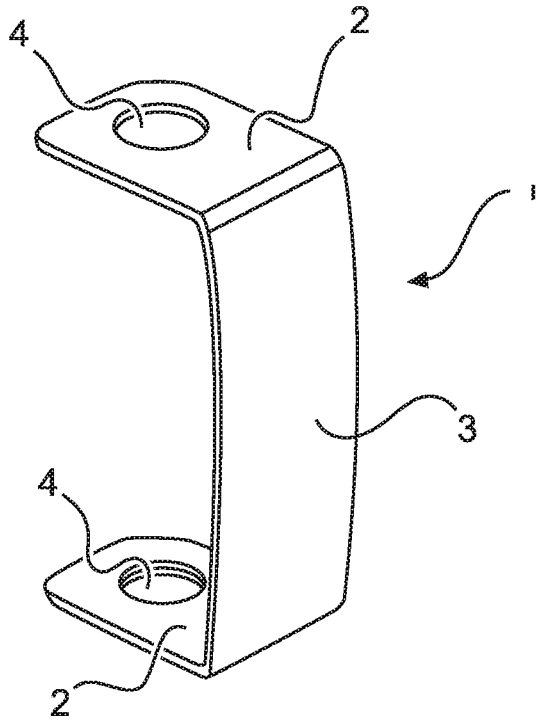
FIG. 1 shows a perspective representation of an integral PE contact.

FIG. 1 shows a perspective representation of an integral PE contact 1. This has the shape of a "u" standing on one of the two limbs 2. The two limbs of the "u" are connected to one another by a connection piece 3. This means that the shape of the PE contact 1 is comparable with a so-called C-carrier. In this set position, the PE contact 1 can be mounted on the mounting frame 5.

The limbs 2 each have a recess 4. The recess 4 is round in design and is used as a through-hole for the fastening means for mounting the PE contact 1 on the mounting frame 5 or for fastening means for mounting a plug insert.

Figure 2:
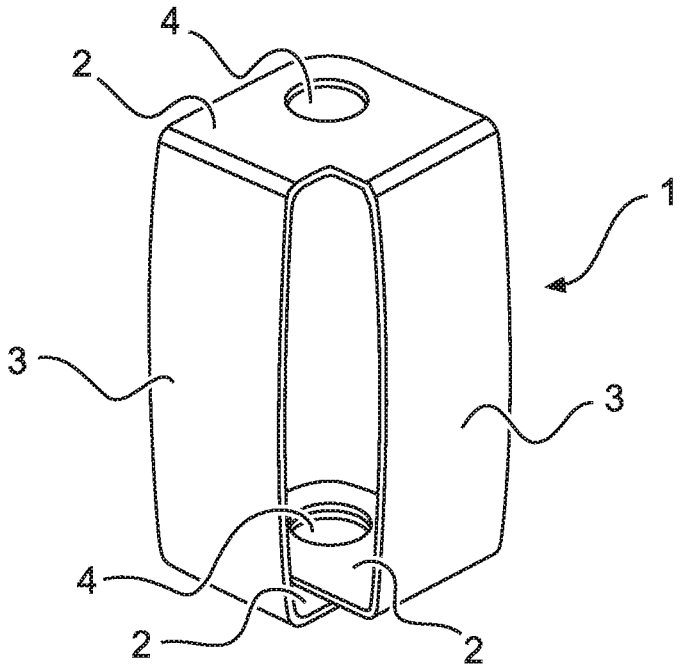
FIG. 2 shows a perspective representation of an alternative integral, two-limb PE contact.

FIG. 2 shows a perspective representation of an alternative integral, two-limb PE contact 1. The PE contact 1 is formed from one part. If the PE contact 1 is observed in a network representation as a plane, a slot divides the connection piece 3, and also one of the two limbs 2, into two parts. Consequently, there is only one connection to a limb 2 opposite the separated limb 2. The opposite integral limb 2 ensures the connection between the three limbs 2 resulting from the section.

The separate limbs 2 each have their own recess 4. The recess 4 in the case of the integral limb 2 is arranged in such a manner that the center point of the circular recess 4 and the center point of the limb 2 coincide with one another. The recess 4 is round in design and is used as the through-hole for a fastening means for mounting the PE contact 1 on the mounting frame 5 or for a fastening means for mounting a plug insert.

Following a bending process, the PE contact 1 is formed in such a manner that the corner edge of the mounting frame 5 can be received in the slot. In this case, the connection pieces 3 lie against the side faces of the mounting frame 5 in planar fashion. The recesses 4 of the two separate limbs 2 lie flush above one another following the bending process. Likewise, the center points of the three recesses 4 lie flush above one another on a line following the bending process.

Figure 3:
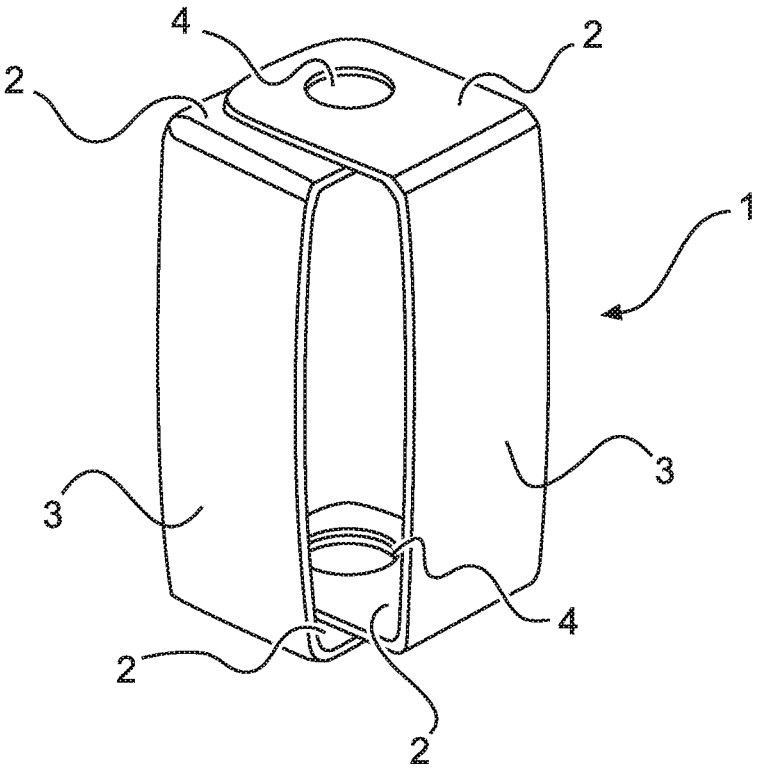
FIG. 3 shows a perspective representation of a two-limb PE contact.

FIG. 3 shows a perspective representation of a two-limb PE contact 1. The PE contact 1 is formed from two parts. These are two of the PE contact 1, as depicted in FIG. 1. These two integral PE contacts 1 are arranged at right angles to one another, so that they correspond to the PE contact 1 in terms of shape, as depicted in FIG. 2.

The arrangement at right angles to one another produces a slot which frames the corner edge of the mounting frame 5. The connection pieces 3 in this case lie against the side faces of the mounting frame 5 in planar fashion. The recesses 4 of the two PE contacts 1 lie flush above one another following assembly. Likewise, the center points of the four recesses 4 lie flush above one another on a line following assembly.

Mounting on the mounting frame 5 takes place as shown in FIGS. 1 and 2 by means of a fastening means which is guided through the recess 4.

Figure 4:
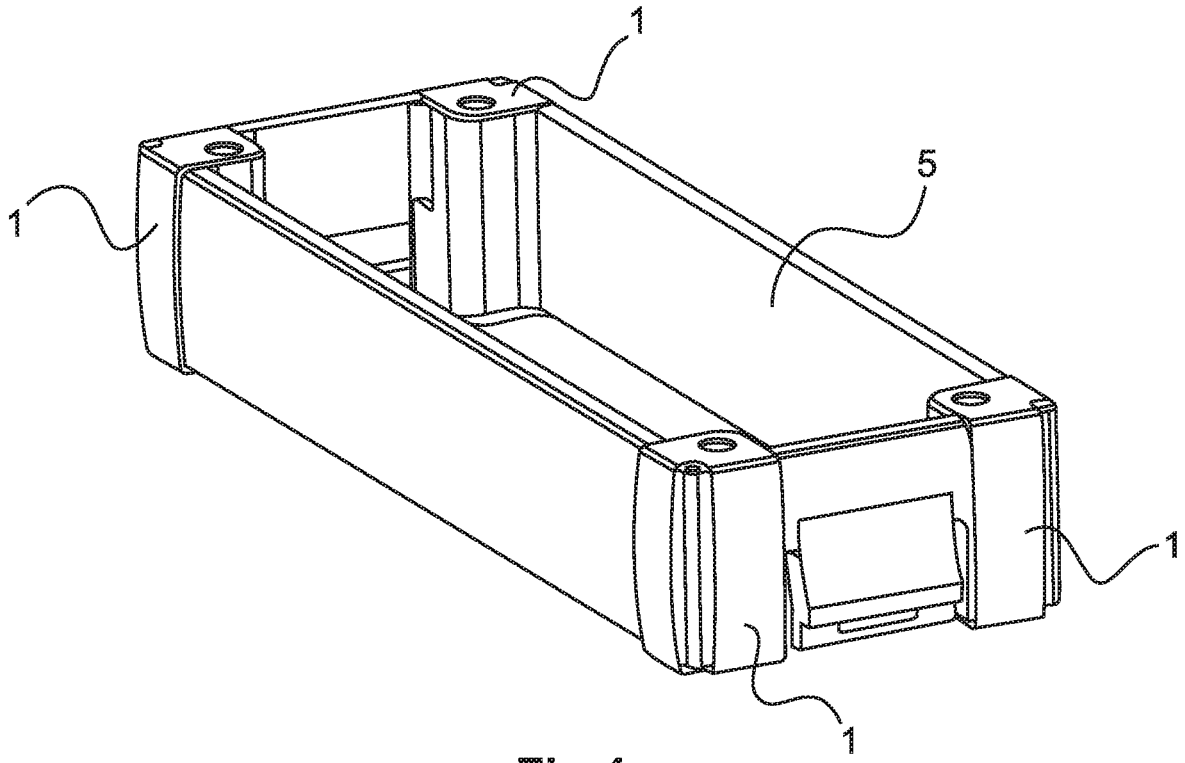
FIG. 4 shows a perspective representation of a mounting frame with PE contacts.

FIG. 4 shows a perspective representation of a mounting frame 5 with four PE contacts 1 which are prepared for mounting. The four PE contacts 1 are each arranged on the corner edges of a rectangular mounting frame 5. They are connected to the mounting frame 5 in a form-fitting manner. Contact may be made with the PE contacts 1 from the terminal end and/or the plug-in end due to the recesses 4 arranged at both ends on each PE contact 1.

The mounting frame 5 depicted in FIG. 4 is made of plastic. It comprises threaded sleeves for fastening the PE contacts 1. The threaded sleeves are made of brass and each have an internal thread in which a fastening means can be mounted.

LIST OF REFERENCE NUMBERS

1 PE contact
2 Limb
3 Connection piece
4 Recess
5 Mounting frame

The invention claimed is:

1. A mounting frame, comprising:

two long side walls;

two short side walls, the long side walls being connected to the short side walls at corner edges to form a generally rectangular hollow cuboid body; and at least one PE contact arranged at one of the corner edges, the at least one PE contact having a first generally flat connecting piece arranged parallel to one of the two long side walls, a first upper limb extending at a right angle from an upper end of the first generally flat connecting piece, a first lower limb extending at a right angle from a lower end of the first generally flat connecting piece parallel to the first upper limb, a second generally flat connecting piece arranged parallel to one of the two short side walls, a second upper limb extending at a right angle from an upper end of the second generally flat connecting piece, and a second lower limb extending at a right angle from a lower end of the second generally flat connecting piece parallel to the second upper limb.

2. The mounting frame as claimed in claim 1, wherein the at least one PE contact has an integral configuration, with the first upper limb and the second upper limb being one piece and the first lower limb and the second lower limb being separate pieces which overlap one another.

3. The mounting frame as claimed in claim 1, wherein the at least one PE contact can be is fixed to the mounting frame in a form-fitting manner.

4. The mounting frame as claimed in claim 1, wherein the at least one PE contact consists of a plurality of PE contacts which are mounted on all four corner edges of the mounting frame.

5. The mounting frame as claimed in claim 1, wherein the at least one PE contact has at least one recess for fastening to the mounting frame.

6. The mounting frame as claimed in claim 1, wherein the at least one PE contact is made of a conductive material.

7. The mounting frame as claimed in claim 1, wherein the mounting frame has at least one threaded sleeve.

8. The mounting frame as claimed in claim 1, wherein the mounting frame is made of plastic.

9. The mounting frame as claimed in claim 1, wherein the at least one PE contact is made of metal.

10. The mounting frame as claimed in claim 1, wherein the at least one PE contact is made of a copper alloy.

11. The mounting frame as claimed in claim 1, wherein the mounting frame is configured to be inserted in a housing from a plug-in end or from a terminal end of the housing, and wherein the at least one PE contact can be contacted from both the terminal end and from the plug-in end of the housing.

* * * * *